US006233985B1

(12) United States Patent
Huang

(10) Patent No.: US 6,233,985 B1
(45) Date of Patent: May 22, 2001

(54) COUPLING LOCK

(76) Inventor: Fu-Chuan Huang, 1F, No.18, Sec.1 Chung Hsin Rd., Wu Ku Hsiang, Taipei County (TW)

( * ) Notice: Subject to any disclaimer, the term of this patent is extended or adjusted under 35 U.S.C. 154(b) by 0 days.

(21) Appl. No.: 09/482,976

(22) Filed: Jan. 14, 2000

(51) Int. Cl.[7] ..... E05B 67/10
(52) U.S. Cl. ..... 70/49; 70/52; 70/387
(58) Field of Search ..... 70/49, 387, 52

(56) References Cited

U.S. PATENT DOCUMENTS

| | | | | |
|---|---|---|---|---|
| 1,382,186 | * | 6/1921 | Godshalk | 70/52 |
| 1,527,336 | * | 2/1925 | Voda | 70/387 |
| 1,540,488 | * | 6/1925 | Mataloni | 70/387 |
| 3,435,642 | * | 4/1969 | Del Pesco | 70/49 |
| 4,502,305 | * | 3/1985 | Bakker | 70/49 |
| 4,831,849 | * | 5/1989 | Kortenbrede | 70/49 |
| 5,146,770 | * | 9/1992 | Yun-Sheng | 70/387 X |
| 5,181,407 | * | 1/1993 | Wu | 70/387 X |
| 5,606,881 | * | 3/1997 | Drake | 70/387 X |
| 5,722,266 | * | 3/1998 | Yeager et al. | 70/49 X |
| 6,092,401 | * | 7/2000 | Sankey et al. | 70/49 X |

FOREIGN PATENT DOCUMENTS

| | | | | |
|---|---|---|---|---|
| 44515 | * | 10/1910 | (AT) | 70/52 |
| 2123850 | * | 11/1972 | (DE) | 70/387 |
| 325346 | * | 2/1930 | (GB) | 70/52 |
| 400567 | * | 10/1933 | (GB) | 70/52 |
| 643943 | * | 9/1950 | (GB) | 70/52 |

* cited by examiner

*Primary Examiner*—Lloyd A. Gall
(74) *Attorney, Agent, or Firm*—Dougherty & Troxell

(57) ABSTRACT

A coupling lock having a base, a catch provided on the base, a restraining member on a free end of the catch. A matching cover is also provided on the base, having a channel with a through hole provided through the channel. The through hole is located so that when the cover is closed upon the base, the catch is inserted into the channel while the restraining member on the catch is deformed to penetrate into the through hole due to the compression by the cover. Such penetration secures the base and the cover together. A locking coil chamber member containing a plurality of pins located in multiple rows is provided on the base.

1 Claim, 5 Drawing Sheets

COUPLING LOCK

BACKGROUND OF THE INVENTION

1. Field of the Invention

The present invention is related to a coupling lock, and more particularly, to a lock that firmly secures together a base and cover without any fixing member.

2. Description of the Prior Art

A prior art of a coupling lock, e.g. that used to lock up a bike, is comprised of a base, an accommodation chamber provided in the base, and a keyway extending outwardly from and connected through said chamber to permit the insertion of a key. A block in said chamber is provided at its front end with multiple channels arranged in a single row, having a pin respectively provided in each of said channels. A lever protrudes outwardly from said block and is connected to a plunger at the other end of said lever and in parallel to said block. One end of said plunger fits into a recess in the lever, while the other end freely fits into the base so as to allow the insertion of a correct key tab. A plurality of holes on the key tab respectively match with corresponding pins to allow the pins to disengage from the channels for the block to move inward, in turn the plunger also moves to unlock by releasing the locking lever. Furthermore, a matching cover is provided above the base and both are provided with holes to accept the insertion of a screw, which fixes together the base and the cover. However, the prior art coupling lock has the following defectives:

1. Relying upon the locking by the screw to tightly incorporate the base and the cover not only makes the assembling sophisticated but also is vulnerable to falling apart due to the loosening of the screw from the locking hole.
2. The single row arrangement of the channels on the block allows only variance in quantity. As a result, the combination can be easily broken.

SUMMARY OF THE INVENTION

The primary objective of the present invention is to provide a coupling lock allowing easy and efficient attachment of the base and the cover.

Another objective of the present invention is to provide a coupling lock comprised of a base, a matching cover, a channel provided on said cover, a catch, and a through hole provided at one side of said channel. Thus, when the cover closes upon the base, the catch is inserted into the channel. A restraint on the catch is deformed due to the compression from the cover and extends into the through hole to hook upon it, thereby firmly securing the base and the cover.

Another objective yet of the present invention is to provide a coupling lock with a locking coil chamber member provided on the base and multiple pins provided in multiple rows in the chamber member to offer more combinations than the single row arrangement of the prior art to frustrate any illegal unlocking attempts.

DETAILED DESCRIPTION OF THE INVENTION

Referring to FIGS. 1, 2, 3 and 4, a preferred embodiment of the present invention is illustrated. It is comprised of a lock set 10 containing a base 20 and a catch 21 protruding outwardly from the base 20. Said catch 21 in the preferred embodiment includes a restraining member 22 extending therefrom at a free end of said catch 21. Said restraining member 22 of the preferred embodiment comprises a tapered protrusion (provided, however, that other elements may be used by those who are familiar with the practices of said art).

Figure 3:
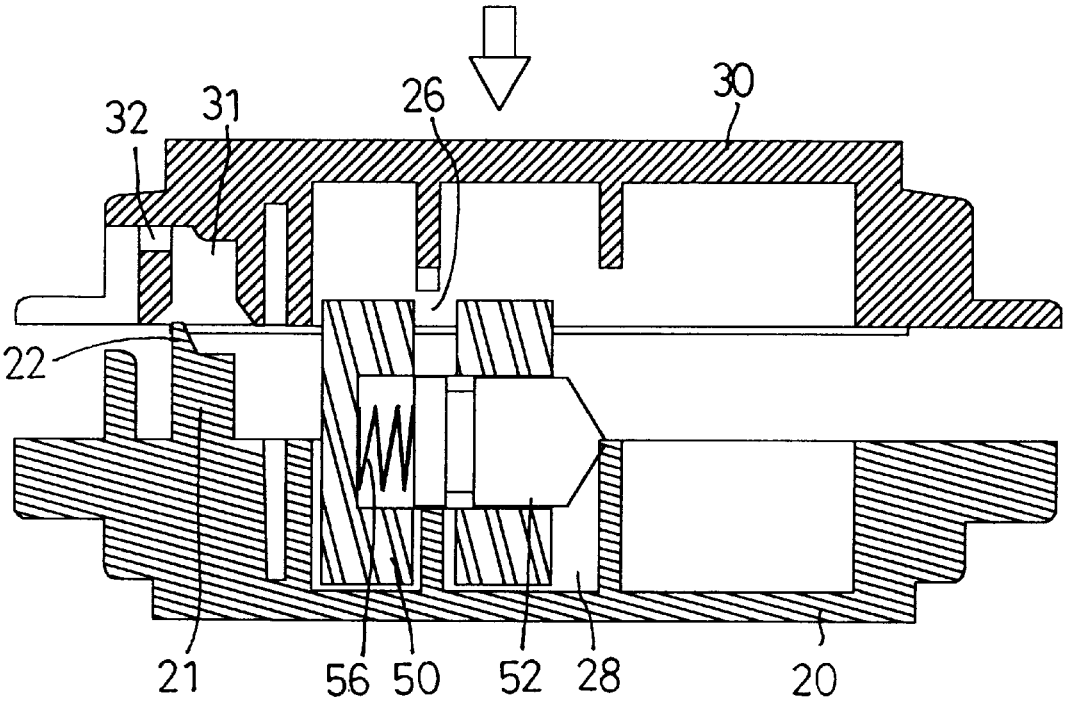
FIG. 3 is a schematic cross-sectional view showing the operation of the present invention.
Figure 4:
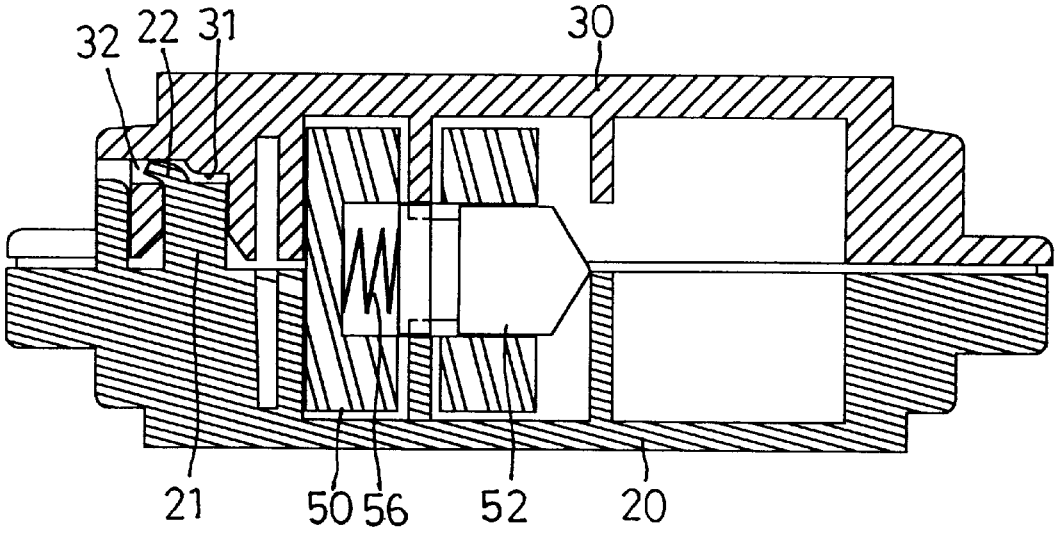
FIG. 4 is another schematic cross-sectional view showing the operation of the present invention
Figure 5:
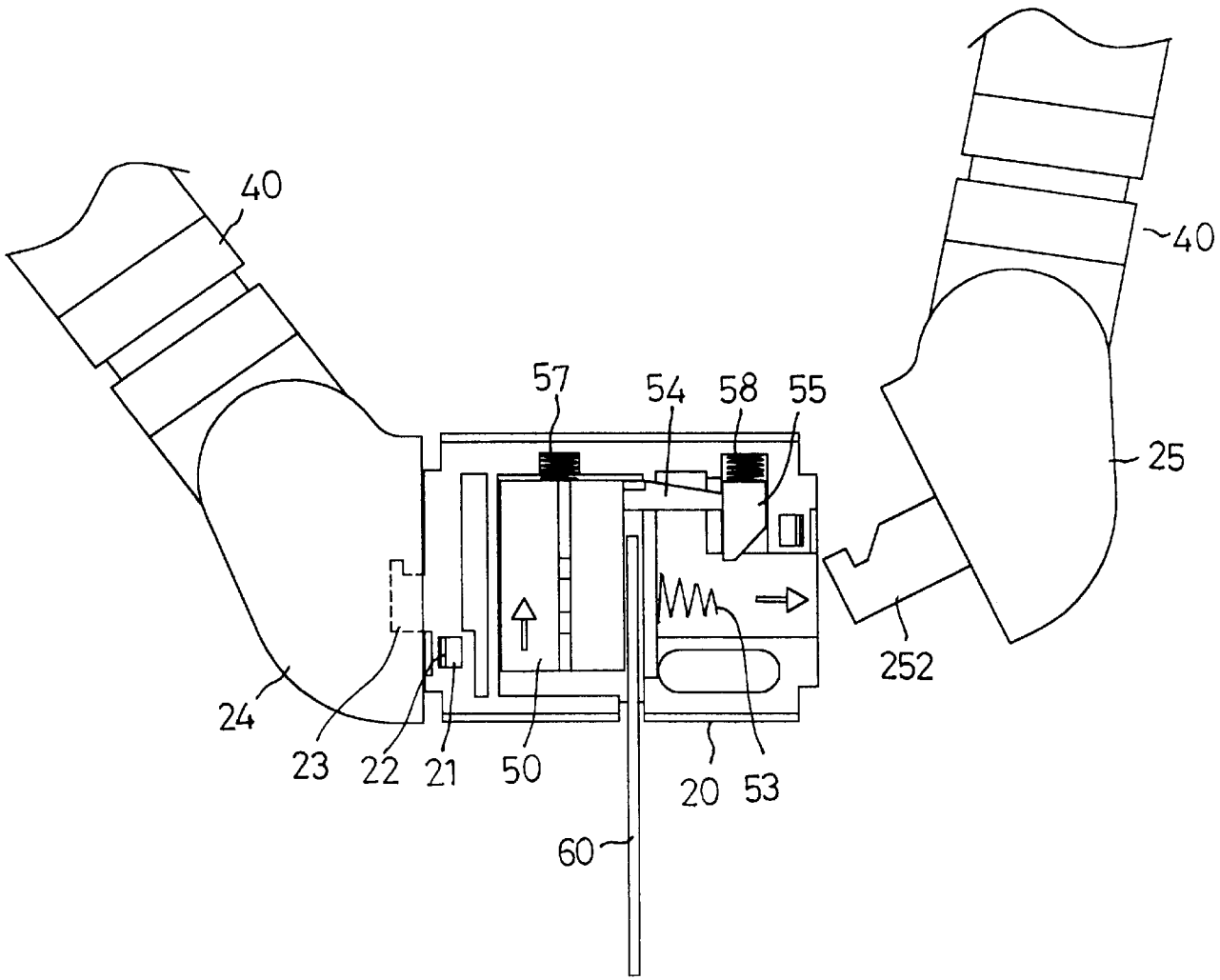
FIG. 5 is a schematic view showing the present invention with a key inserted.

A matching cover 30 is provided on the base 20, including a channel 31 vertical to the cover provided on said cover corresponding to the location of catch 21. A laterally extending through hole 32 is provided through the channel 31 located so that, when the cover 30 closes upon the base 20, the catch 21 is inserted into the channel 31 and the restraining member 22 is deformed to penetrate into the through hole 32 due to the pressure created by the cover 30. Consequently, both the base 20 and the cover 30 are firmly secured together as illustrated in FIGS. 3 and 4.

Figure 1:
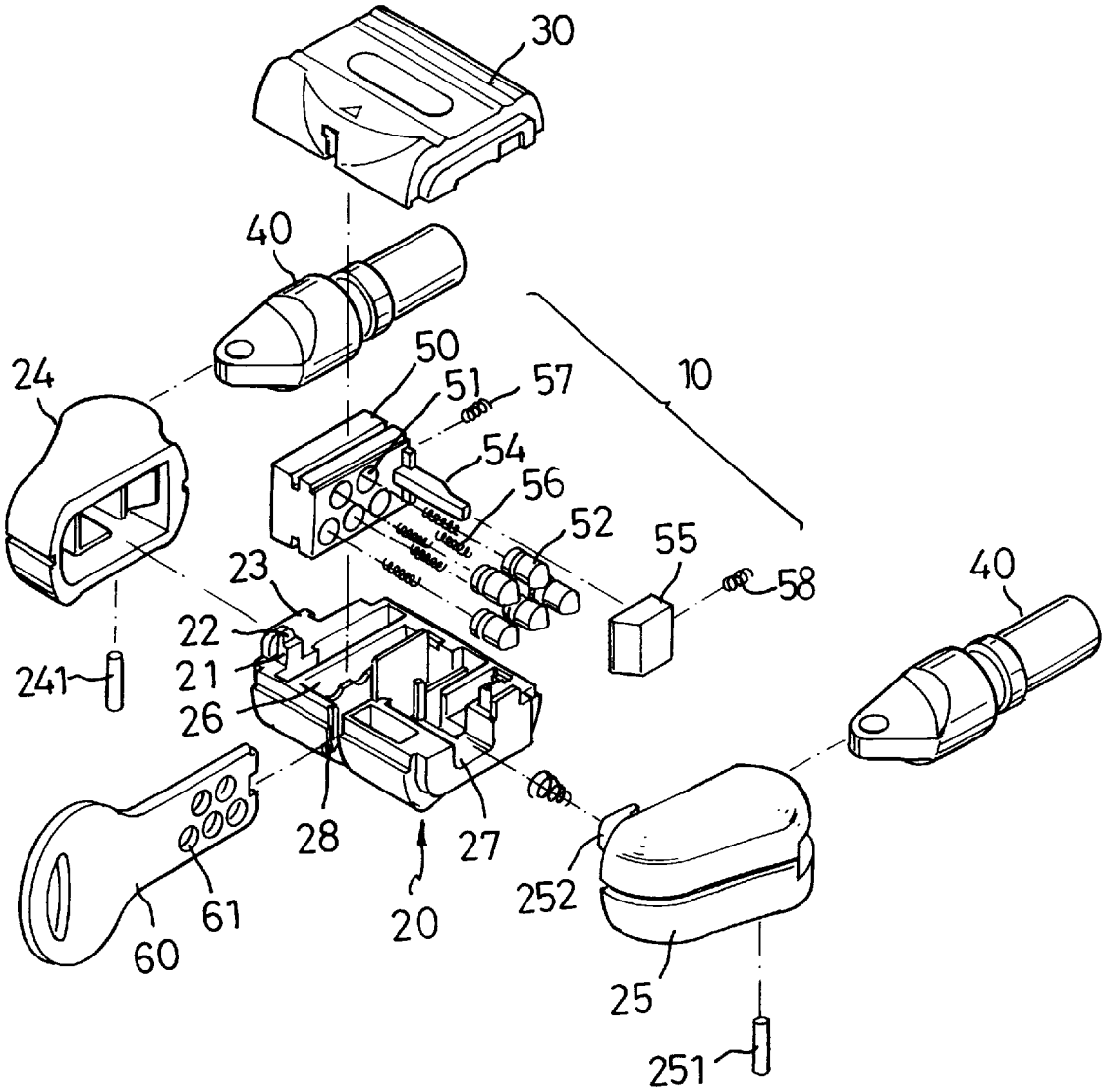
FIG. 1 is an exploded view of the present intention.
Figure 2:
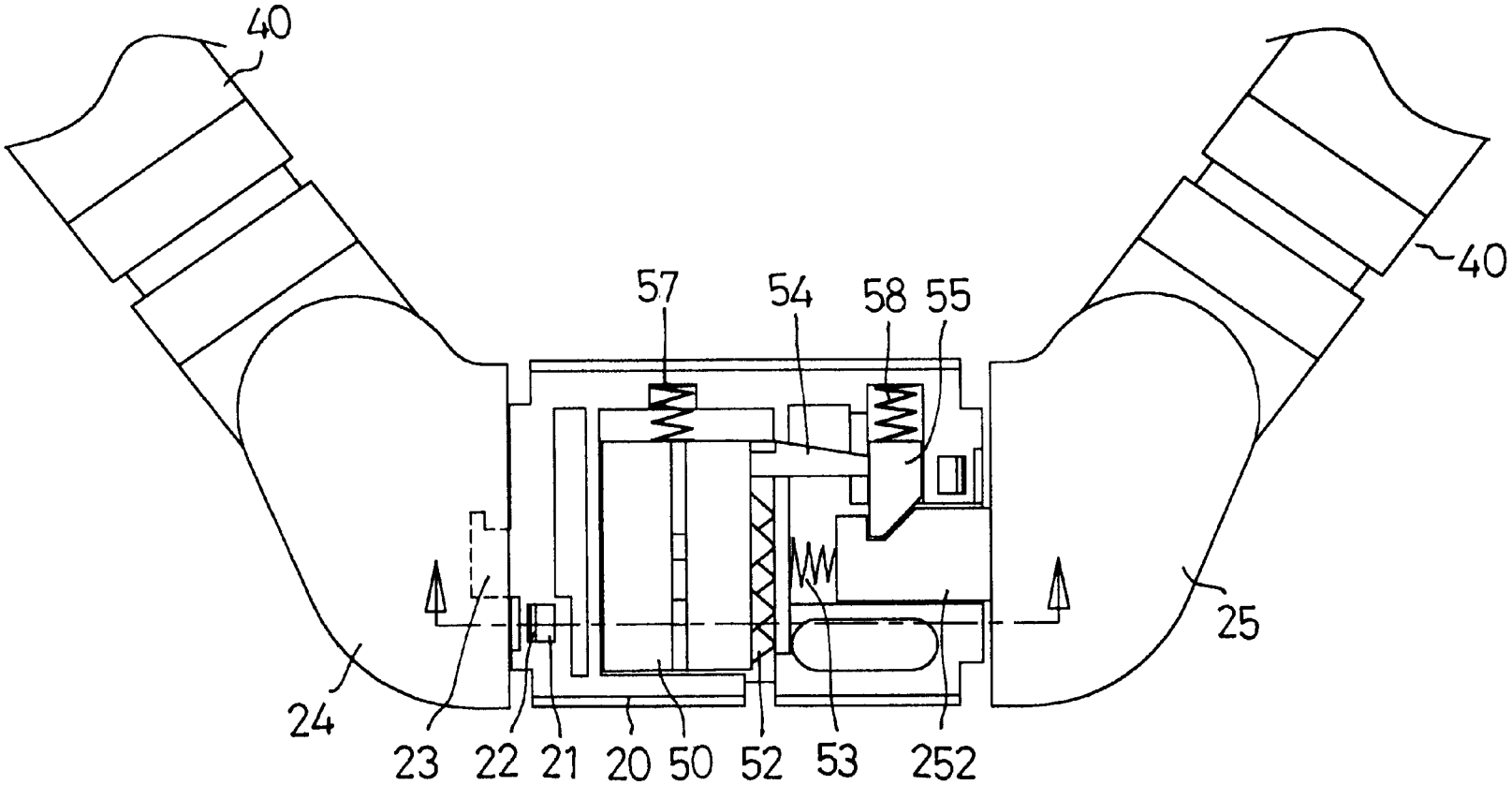
FIG. 2 is a schematic view of the present invention showing the incorporated base and cover.

Furthermore, as illustrated in FIGS. 1 and 2, a block 23 extending outwardly from one side of said base 20 engages connector 24. Said connector 24 is incorporated into one end of a locking lever 40 with a bolt 241 and another end of said locking lever 40 is connected to a mobile block 25 with another bolt 251. Catch 252 protrudes outwardly from said mobile block 25 and extends into the open channel 27 of the base 20 and bears against a resilient member 53.

A recess 26 is provided in said base 20 to accommodate a locking coil chamber member 50. A plurality of laterally extending channel holes 51 with corresponding pins 52 are arranged in multiple rows in the chamber member 50. One end of each pin 52 contacts another resilient member 56, which is in the form of a coil in the preferred embodiment (provided, however, that other member may be used by those who are familiar with the practices of said art). Said pins 52 are kept partially exposed from the chamber member 50 by the force of said resilient members 56. One side of said chamber member 50 is connected to a resilient member 57 with one end resting on the base 20. Furthermore, a laterally extending link 54 is provided on the chamber member 50. Said link 54 is a lever in the preferred embodiment (provided, however, that other member may be used by those who are familiar with the practices of said art). Said link 54 is connected to a locking bolt 55. One side of said locking bolt 55 is connected to another resilient member 58 with one end resting on the base 20 urging said locking bolt 55 to merely snap on the catch 252 of the mobile block 25. An insertion channel 28 connected to a space 26 is provided in the surface of the cover 30 and base 20 to permit the insertion of a key 60 as illustrated in FIGS. 1 and 2.

Figure 6:
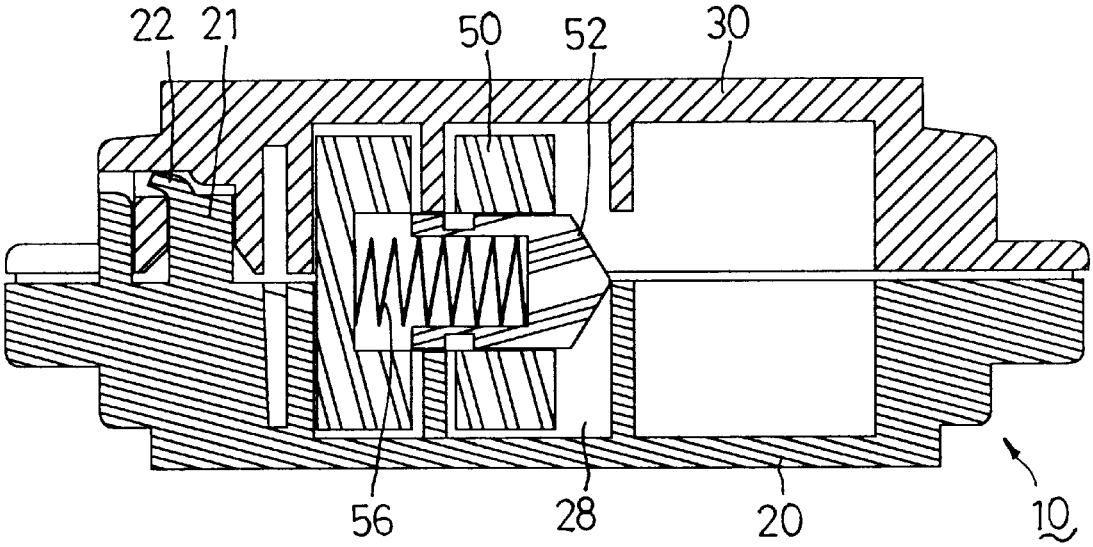
FIG. 6 is a schematic cross-sectional view showing the present invention without a key inserted.
Figure 7:
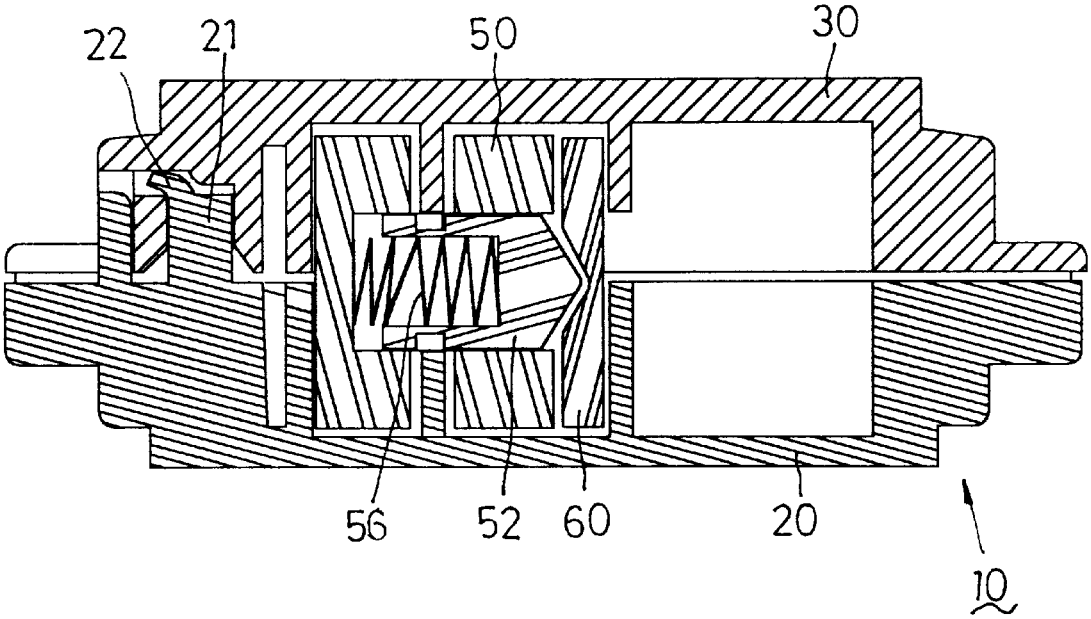
FIG. 7 is a sectional cross-sectional view of the present invention with the key inserted.

Now referring to FIGS. 2, 5 6 and 7, the key 60 is inserted into the insertion channel 28 and both of the key 60 and a matching concavity 61 rest upon the pins 52. The exposed portions of the pins 52 outside the chamber member 50, as illustrated in FIG. 6, retreats into the chamber member 50 due to the compression by the key 60, as illustrated in FIG.

7. In turn the key 60 keeps moving forward to push against the link 54 and the entire chamber member 50 moves, then the locking bolt 55 also moves accordingly to disengage from the catch 252. Finally, the locking lever 40 on the catch 252 is separated from the lock 10. Since the pins 52 in the chamber member 50 are not arranged on the same row, they provide more variety of combinations to prevent easy unlocking of the lock 10 without correct key.

What is claimed is:

1. A releasable coupling lock comprising:

a) a lock set comprising:

i) a housing including a base having a catch with a restraining member extending from a free end of the catch and a matching cover including a channel aligned with the catch, a wall bounding one side of the channel having a through hole, the cover being fixedly attached to the base by deformation of the restraining member into engagement with the through hole;

ii) a locking coil chamber member slidably located in the housing, the locking coil chamber member having a plurality of movable pins arranged in a plurality of rows, and a link extending therefrom, the locking coil chamber member movable between locked and unlocked positions within the housing;

iii) a locking bolt slidably located in the housing and engaged with the link and movable with the locking coil chamber member between locked and unlocked position;

iv) at least one spring device biasing the locking coil chamber member and the locking bolt toward the locked position; and, v) an insertion channel in the housing to facilitate insertion of a key into the housing;

b) a locking lever having a first end attached to a first side of the housing, and a second end mounted to a mobile block having a second catch insertable into a second side of the housing so as to be engaged by the locking bolt when in the locked position; and, c) a key having a plurality of concavities therein equal to the plurality of movable pins, such that, when the key is inserted into the housing, the pins are moved by the key thereby allowing an end of the key to engage the link and move the locking coil chamber member and the locking bolt to the unlocked position.

* * * * *